United States Patent [19]

Hellsten et al.

[11] Patent Number: 4,732,667

[45] Date of Patent: Mar. 22, 1988

[54] PROCESS AND COMPOSITION FOR THE FROTH FLOTATION BENEFICIATION OF IRON MINERALS FROM IRON ORES

[75] Inventors: Martin Hellsten, Odsmal; Marie Ernstsson, Goteborg; Bo Idstrom, Stenungsund, all of Sweden

[73] Assignee: Berol Kemi AB, Stenungsund, Sweden

[21] Appl. No.: 703,241

[22] Filed: Feb. 20, 1985

[51] Int. Cl.[4] ..... B03D 1/14

[52] U.S. Cl. ..... 209/166; 209/167; 252/61

[58] Field of Search ..... 209/166, 167; 252/61

[56] References Cited

U.S. PATENT DOCUMENTS

| | | | |
|---|---|---|---|
| 2,904,177 | 9/1959 | Michal | 209/166 |
| 3,179,250 | 4/1965 | Bunge et al. | 209/166 |
| 4,168,227 | 9/1979 | Polgaire et al. | 209/166 |
| 4,358,368 | 11/1982 | Hellsten et al. | 209/167 |
| 4,421,641 | 12/1983 | Blazy et al. | 209/167 |
| 4,529,507 | 7/1985 | Bull et al. | 209/166 |

FOREIGN PATENT DOCUMENTS

| | | | |
|---|---|---|---|
| 605638 | 4/1978 | U.S.S.R. | 209/166 |

*Primary Examiner*—Bernard Nozick

[57] ABSTRACT

A process and composition are provided for the froth flotation beneficiation of iron minerals from iron ores containing silicate and phosphate minerals, comprising as collectors a combination of a primary amine and a nitrogen compound containing an anionic group selected from methylene carboxylic acid, ethylene phosphoric acid and methylene phosphonic acid.

26 Claims, 1 Drawing Figure

Figure 1:
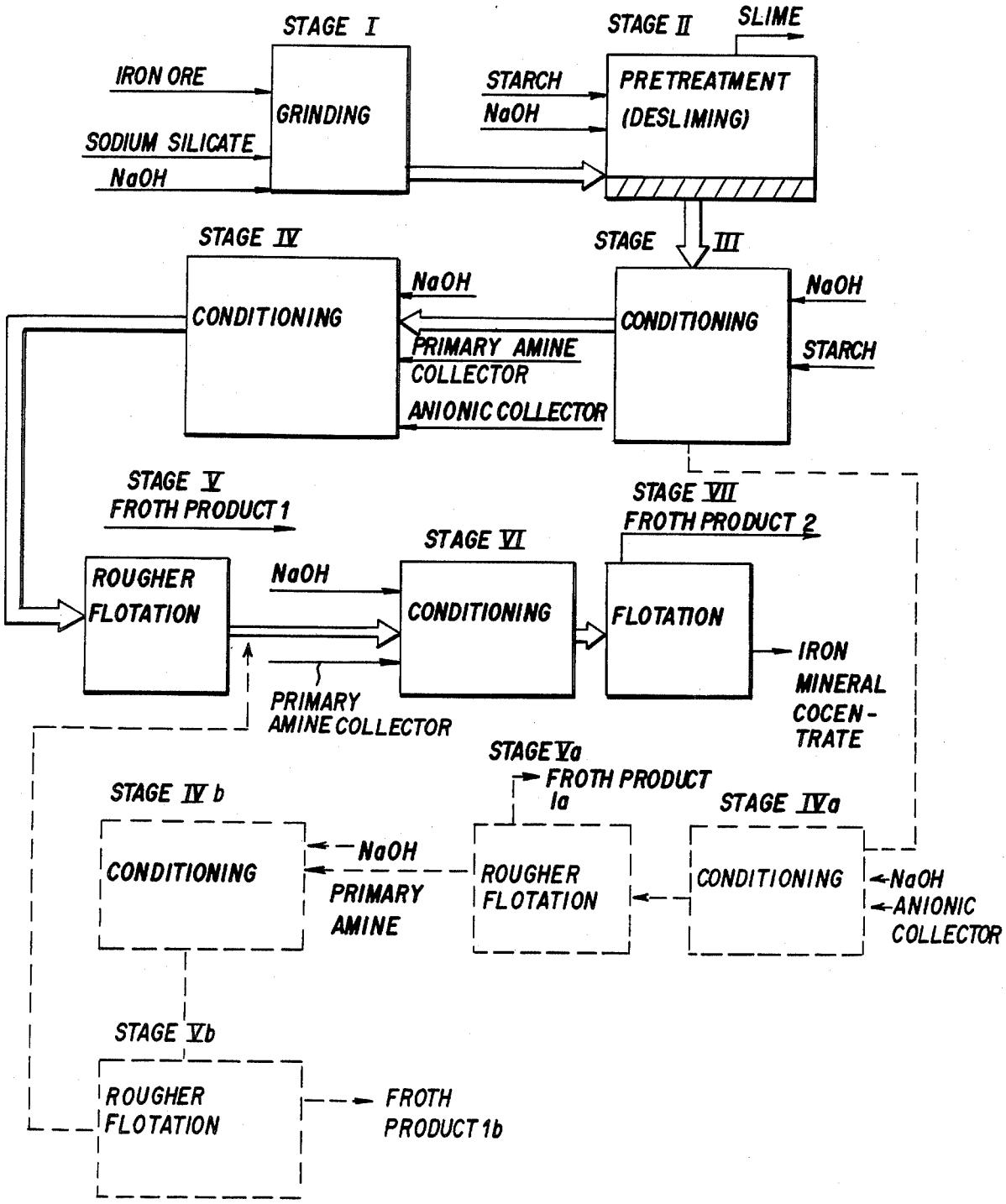

PROCESS AND COMPOSITION FOR THE FROTH FLOTATION BENEFICIATION OF IRON MINERALS FROM IRON ORES

Iron ores are commonly subjected to froth flotation to separate the iron minerals, such as hematite, using fatty acids as a collector. However, the selectivity of fatty acids for the iron minerals is accepted as inadequate.

Nowadays an aliphatic amine is used as a selective collector in froth flotation for many gangue minerals such as silicates. In an initial desliming stage and/or in the main froth flotation stage, starch or a starch derivative is added, as a depressant for the iron minerals.

It is known to suggest use in froth flotation of an aliphatic diamine in combination with a dimer acid or a beta-amino acid. The advantage is claimed to be an unusual high content of iron in the iron concentrate.

While these methods give adequate beneficiation of the iron minerals, small amounts of phosphate minerals are enriched at the same time in the iron mineral concentrates. These small amounts of phosphate minerals (from about 0.05% by weight of phosphor) turn up as unacceptably high contents of phosphorus in the iron product.

Hellsten and Klingberg, U.S. Pat. No. 4,358,368, patented Nov. 9, 1982, provides a process for the froth flotation of calcium phosphate-containing minerals which comprises carrying out the flotation in the presence of an amphoteric flotation agent having the general formula:

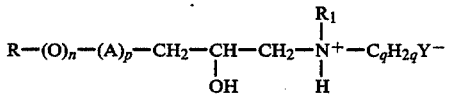

wherein:

R is a hydrocarbon group having from about seven to about twenty-four carbon atoms;

A is an oxyalkylene group having from two to about four carbon atoms;

$R_1$ is selected from the group consisting of hydrogen and hydrocarbon groups having from one to about four carbon atoms;

Y is selected from the group consisting of $COO^-$ and $SO_3^-$;

n is a number from 0 to 1;

p is a number from 0 to 5;

q is a number from 1 to 2;

and salts thereof.

This collector reagent is disclosed in Examples 4 and 5 to be selective for calcium phosphate present with iron minerals and silicates in waste material from magnetically enriched iron ore.

The process and composition of the invention provide an iron concentrate having a lower content of phosphate minerals without a lowered content of iron mineral. Indeed, the iron content in the concentrate may even be increased.

The invention accomplishes this by utilizing as collectors for the gangue minerals a combination of a primary amine and a nitrogen compound having an anionic group selected from the group consisting of methylene carboxylic acid groups, methylene phosphonic acid groups, and ethylene phosphoric acid groups, including, optionally, as a third ingredient, a depressant for the iron minerals.

The primary amine has the general Formula I:

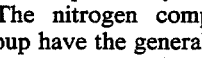

I in which:

$R_1$ is a hydrocarbon group having from about six to about eighteen carbon atoms;

$n_1$ and $n_2$ are 2 or 3; and $m_1$ is from 0 to 4, preferably 0 or 1 and $m_2$ is from 0 to 2, preferably 0 or 1.

The nitrogen compounds containing an anionic group have the general Formula II:

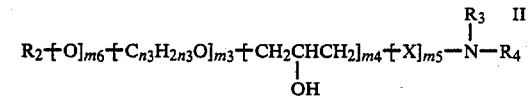

II in which:

$R_2$ is a hydrocarbon group having from about one to about twenty-four carbon atoms;

X is a group

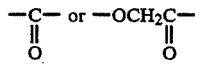

$n_3$ is a number from 2 to 4;

$m_3$ is a number from 0 to 4, and can be an average number;

$m_4$ is 0 or 1;

$m_5$ is 0 or 1;

$m_6$ is 0 or 1;

$R_3$ is selected from the group consisting of hydrogen; hydrocarbon groups having from one to about eighteen carbon atoms; and

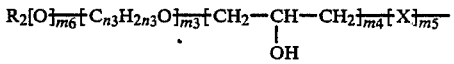

$R_4$ is selected from the group consisting of methylene carboxylic acid $—CH_2COOH$; methylene phosphonic acid

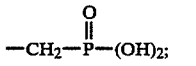

and ethylene phosphoric acid

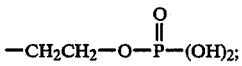

and salts thereof with an inorganic or organic cation.

The anionic group containing compound preferably has a total number of carbon atoms in the hydrocarbon groups of $R_2$ and $R_3$ within the range from about twelve to about twenty-five, and $m_4$ is 1. The number of carbon atoms of each hydrocarbon group in $R_2$ and $R_3$ is preferably within the range from about one to about eighteen.

Exemplary $R_1$, $R_2$ and $R_3$ hydrocarbon groups include aliphatic hydrocarbon groups (which are preferred as $R_1$) such as methyl, ethyl, propyl, isopropyl, butyl, isobutyl, tert-butyl, amyl, isoamyl, tert-amyl, sec-amyl ($R_3$ only), hexyl, isohexyl, tert-hexyl, sec-hexyl, heptyl, octyl, isooctyl, 2-ethyl hexyl, nonyl, isononyl, tert-nonyl, decyl, isodecyl, dodecyl, tetradecyl, hexadecyl, octadecyl, octadecenyl, linoleyl, linolenyl, and behenyl; cycloaliphatic hydrocarbon groups, such as cyclopropyl; cyclobutyl; cyclopentyl; cyclohexyl; cycloheptyl; and cyclooctyl; and aromatic hydrocarbon groups, such as phenyl, methyl phenyl, dimethyl phenyl, propyl phenyl, butyl phenyl, octyl phenyl, nonyl phenyl, and dodecyl phenyl.

Especially preferred are those amines in which $R_1$ is aliphatic and $m_2$ is 0. These primary amines are known compounds.

Exemplary $-[C_{n1}H_{2n1}O]-$ and $-[C_{n3}H_{2n3}O]-$ groups include ethyleneoxy; propyleneoxy-1,2; butyleneoxy-2,3; and butyleneoxy-1,2($C_{n3}H_{2n3}O$ only).

Exemplary primary amines include:

$C_{10}H_{21}—NH_2$ $C_{10}H_{21}O(CH_2)_3NH(CH_2)_3NH_2$ $(C_{8\text{-}10}H_{17\text{-}21})—O(CH_2)_3—NH_2$ $C_7H_{15}NHCH_2CH_2CH_2NH_2$ $C_{14}H_{29}OCH_2CH_2CH_2NHCH_2CH_2NH_2$ $C_{18}H_{37}OC_2H_4OC_3H_6NH_2$ $C_{18}H_{37}OCH_2CH_2CH_2NHCH_2CH_2NH_2$ $C_{16}H_{33}(OC_2H_4)_2OC_3H_6NH_2$ $C_8H_{17}OCH_2CH_2CH_2NH$ $C_{16}H_{33}(OC_2H_4)_3OC_3H_6NHC_3H_6NH_2$ $C_{12}H_{25}OCH_2CH_2CH_2NHCH_2CH_2NH_2$ $$C_{18}H_{37}NHCH_2\underset{\underset{CH_3}{|}}{CH}—NH_2$$

Exemplary nitrogen compounds containing an anionic group include:

$$(C_8H_{17}OCH_2\underset{\underset{OH}{|}}{CH}CH_2)_2NCH_2COOH$$

$$C_{13}H_{27}OCH_2\underset{\underset{OH}{|}}{CH}CH_2\underset{\underset{CH_3}{|}}{N}—CH_2COOH$$

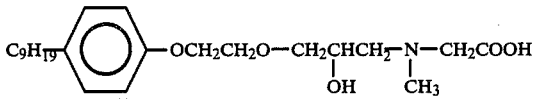

$$C_8H_{17}CH{=}CH—C_7H_{15}\overset{\overset{O}{\|}}{C}—\overset{\overset{CH_3}{|}}{N}—CH_2COOH$$

$$(C_8H_{17})_2NCH_2PO_3H_2$$

$$(C_8H_{17}OCH_2\underset{\underset{OH}{|}}{CH}CH_2)_2NCH_2CH_2OPO_3H_2$$

$$(C_8H_{17})_2NCH_2CH_2OPO_3H_2$$

$$(\text{2-ethyl hexyl-}OCH_2\underset{\underset{OH}{|}}{CH}CH_2)_2NCH_2CH_2OPO_3H_2$$

$$\text{iso-}C_6H_{13}[OCH_2CH_2]_4OCH_2\underset{\underset{OH}{|}}{CH}—CH_2—OCH_2\underset{\underset{O}{\|}}{C}NHCH_2COOH$$

$$C_{18}H_{35}[OCH_2CH_2]_3O—CH_2\underset{\underset{OH}{|}}{CH}—CH_2\underset{\underset{CH_3}{|}}{N}CH_2COOH$$

-continued $$C_{18}H_{37}[OCH_2CH_2]_4OCH_2\underset{\underset{OH}{|}}{CH}—CH_2NHCH_2\underset{\underset{O}{\|}}{P}(OH)_2$$

$$C_{16}H_{33}OCH_2CH_2OCH_2\underset{\underset{OH}{|}}{CH}CH_2\underset{\underset{CH_3}{|}}{N}CH_2CH_2O\underset{\underset{O}{\|}}{P}(OH)_2$$

$$[C_{10}H_{21}OCH_2\underset{\underset{OH}{|}}{CH}—CH_2]_2NCH_2COOH$$

$$[\text{iso-}C_7H_{15}O—CH_2CH_2OCH_2\underset{\underset{OH}{|}}{CH}CH_2]_2NCH_2\underset{\underset{O}{\|}}{P}(OH)_2$$

$$\text{tert-}C_8H_{17}—[O\underset{\underset{CH_3}{|}}{CH}CH_2]_2OCH_2\underset{\underset{OH}{|}}{CH}CH_2\underset{\underset{C_8H_{17}}{|}}{N}—CH_2COOH$$

$$C_{11}H_{23}\underset{\underset{O}{\|}}{C}—\underset{\underset{CH_3}{|}}{N}—CH_2COOH$$

$$C_{12}H_{25}(OCH_2CH_2)_2OCH_2\underset{\underset{O}{\|}}{C}—\underset{\underset{CH_3}{|}}{N}CH_2COOH$$

$$[C_{12}H_{25}—(O\underset{\underset{CH_3}{|}}{CH}\underset{\underset{CH_3}{|}}{CH})_4OCH_2\underset{\underset{OH}{|}}{CH}CH_2]_2NCH_2CH_2O\underset{\underset{O}{\|}}{P}(OH)_2$$

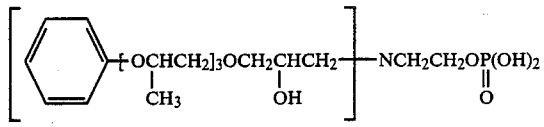

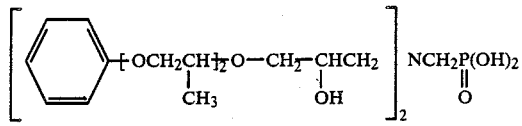

FIG. 1 is a flow sheet showing the froth flotation process in accordance with the invention.

If mixtures of two or more types of minerals are subjected to froth flotation using two ionic collectors of opposite charge, very often problems occur, since the collectors may interfere with each other. The interference may result in larger reagent consumption, frothing problems, and high losses of the valuable mineral, in this case, the iron mineral. However, in the process of the present invention, none of these drawbacks occurs.

While in general it is more efficient to utilize the primary amine and the anionic group containing collectors together, in admixture, they can be used separately, in sequential steps.

Each of the collectors is normally added in an amount within the range from about 5 to about 250 g per ton of ore, preferably within the range from about 5 to about 100 g per ton of ore.

The compound containing the anionic group can be produced from commercially available starting compounds using known methods, such as disclosed in U.S. Pat. No. 4,358,368, patented Nov. 9, 1982.

The group $R_2$ if aliphatic is derived from an alcohol, such as Ziegler, Oxo and fatty alcohols, for example, butanol, iso-butanol, secondary-butanol, hexanol, secondary-hexanol, iso-hexanol, 2-ethyl hexanol, octanol, lauryl alcohol, myristyl alcohol, cetyl alcohol, stearyl alcohol, oleyl alcohol, and behenyl alcohol.

When $R_2$ is cycloaliphatic or aromatic, cycloaliphatic alcohols and aromatic phenols can be utilized as the starting material. Suitable cycloaliphatic alcohols are cyclopropanol, cyclobutanol, cyclopentanol, cyclohexanol, cycloheptanol, and alkylsubstituted cycloalcohols. Suitable aromatic phenols include synthetically manufactured mono- and dialkyl-substituted phenols, such as octyl phenol, nonyl phenol, dodecyl phenol, and dibutyl phenol.

The $R_3$ hydrocarbon group or hydrogen and/or the $R_4$ acid group can be introduced using a compound having the Formulae III, IV, V or VI:

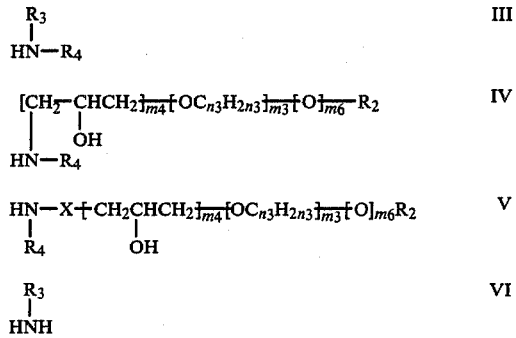

in which $R_3$, $R_4$, $m_3$, $m_4$, $m_5$, and $m_6$ are as above in Formula II. Tertiary amines in which $R_3$ is methyl, 2-ethyl hexyl, decyl, or an isomer thereof or phenyl and $R_4$ is

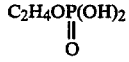

are preferred.

When $R_3$ is the group having the formula

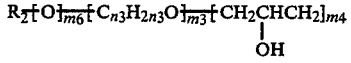

the tertiary amine can be obtained by reacting two moles of the alkylene oxide having the formula

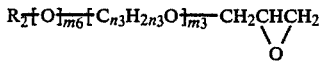

with one mole of the amine having the formula $H_2NR_4$.

The depressant can be any conventional mineral depressant, such as a hydrophilic polysaccharide. Suitable hydrophilic polysaccharides include cellulose esters, such as carboxymethyl cellulose and sulphomethyl cellulose; cellulose ethers, such as methyl cellulose, hydroxyethyl cellulose, hydroxymethyl cellulose, and ethyl hydroxyethyl cellulose; the hydrophylic natural gums, such as gum arabic, gum karaya, gum tragacanth; and gum ghatti; the alginates; and starch, such as corn starch, and starch derivatives, such as carboxymethyl starch and starch phosphate. Polysaccharides having anionic groups are preferred.

The depressant should be present in the mineral pulp before each flotation process in a sufficient amount to prevent the iron mineral from floating. Normally, the amount of depressant is within the range from about 10 to about 1000 grams per ton ore, but this amount is not critical.

The primary amine and the anionic group containing compound can be combined and marketed as a collector composition, ready for addition to the ore at the froth flotation step, in the desired proportion to each other. The primary amine and anionic group-containing compound can be in liquid form, in solution in water or a water-miscible inert solvent. The amines can be solubilized as the acid salt with an inorganic acid, such as a hydrochloric acid, sulfuric acid, nitric acid, acetic acid or formic acid, or the anionic group containing compound as the salt of the carboxylic acid, phosphonic acid or phosphoric acid group with an alkali metal hydroxide such as sodium hydroxide or ammonia. Solid amines can be marketed in solid form.

The relative proportions of the primary amine and anionic group-containing compound are not critical, and can normally be within the range from 4:1 to 1:4, preferably 2:1 to 1:2.

In the process shown in the flow sheet of FIG. 1, the primary amine and anionic collector are present together in the rougher flotation step, which is a preferred process due to the simplicity of the equipment.

As seen in FIG. 1, in Stage I the iron ore, together with water, sodium hydroxide and sodium silicate, are ground to a particle size, suitable for froth flotation. The ground ore slurry then passes to Stage II, where the ore is pretreated with starch and sodium hydroxide to adjust pH, resulting in slime formation. The slime rises to the surface of the slurry, and is removed. The ore is then conditioned for several minutes in Stage III, with addition of more sodium hydroxide to adjust pH, and starch, and then in Stage IV the primary amine and anionic collector are added with more sodium hydroxide to adjust pH, and conditioned for several more minutes. The slurry is subjected to a rougher flotation in Stage V. The gangue at the surface is removed as Froth Product I, and the bottom iron mineral concentrate passed to the Stage VI conditioning, after addition of more primary amine, and sodium hydroxide to adjust pH. After conditioning for several minutes, there follows a second froth flotation, separating a Froth Product 2, and recovering the iron mineral concentrate product.

If desired, the primary amine and anionic group containing compound can be used in separate steps, shown in dashed lines in FIG. 1. In this case, anionic collector only is added with sodium hydroxide in Stage IV a, followed by a rougher flotation Stage Va, and then primary amine is added with sodium hydroxide in Stage IVb, followed by a rougher flotation in Stage Vb. The other stages are as in solid lines in FIG. 1.

The froth flotation processing conditions form no part of the invention and are entirely conventional. The conditioning and flotation steps can be carried out at room or ambient temperature, but elevated temperatures can be used, up to about 100° C., or the volatilization temperature of the amine, if lower. The pH is usually on the alkaline side, and preferably between pH 8 and pH 12.

The following Examples represent preferred embodiments of the process of the invention.

EXAMPLES 1 TO 11

Froth flotations were carried out in accordance with the flow sheet shown in FIG. 1.

An iron ore containing Fe 34%, Si 23.9% and P 0.044%, mainly present as hematite 49%, silicate (quartz) 51%, and apatite 0.24%, was crushed to particles less than 1.7 mm in diameter and homogenized. From the homogenized material portions of 600 grams each were taken out. The portions were further ground in a laboratory rod mill for 30 minutes together with 400 ml of water, 0.40 g sodium hydroxide and 0.27 g water glass (38% sodium silicate by weight, weight ratio $SiO_2/NaO_2=3.22$, 41.0° Bé).

The particle distribution was such that 97% by weight passed through a 32 μm mesh sieve.

An aqueous mineral pulp 8 liters in volume was prepared from each portion of the ground material. Temperature and pH were adjusted to about 20° C. and 10.5, respectively. 0.0675 g of prehydrolyzed corn starch was added, and the whole was conditioned in a paddle mixer for 2 minutes.

The conditioned pulp was allowed to settle for 3 minutes, and then the slime was siphoned off. The deslimed pulp was divided into four fractions, and each fraction transferred to a flotation cell and diluted with water to a volume of 0.5 liter. The pH was adjusted to 10.5 with sodium hydroxide, followed by the addition of 0.0675 g of the prehydrolyzed corn starch. After conditioning for 2 minutes, and a final pH adjustment to 11.0, the anionic collector and primary amine collectors were added. The amount of the primary amine was 0.0067 g, and the amount of the anionic collector is given in Table I. After an additional conditioning for 2 minutes, a rougher flotation was carried out, giving a Froth Product 1 and a bottom iron mineral concentrate. The pH was again adjusted to 11 with sodium hydroxide, 0.0067 g of primary amine was added to the bottom concentrate, and the whole conditioned for 2 minutes, followed by another froth flotation, giving a Froth Product 2, and iron mineral concentrate. The primary amines and anionic group containing compounds used and the results obtained are shown in Table I.

TABLE I

| Example No. | Anionic Collector | g/ton | Primary Amine Collector | Feed % P Assay | Slimes % Wt. | Deslimed Pulp % P Assay | Iron Mineral Concentrate % Wt. | % Fe Grade | % Fe Recovery | % $SiO_2$ Assay | % P Assay | P distribution in % of flotation feed |
|---|---|---|---|---|---|---|---|---|---|---|---|---|
| Control | None | — | $(C_{8-10}H_{17-21})-O(CH_2)_3-NH_2$ | 0.043 | 32.2 | 0.033 | 37.9 | 66.0 | 74.7 | 5.8 | 0.048 | 81.6 |
| 1 | $(C_8H_{17}-OCH_2CH(OH)CH_2)_2-NCH_2COOH$ | 54 | $C_{10}H_{21}-NH_2$ | 0.045 | 32.4 | 0.037 | 38.8 | 67.0 | 77.7 | 4.3 | 0.034 | 52.0 |
| 2 | $(C_8H_{17}-OCH_2CH(OH)CH_2)_2-NCH_2COOH$ | 54 | $C_{10}H_{21}O(CH_2)_3NH(CH_2)_3NH_2$ | 0.044 | 32.4 | 0.035 | 41.1 | 65.2 | 80.0 | 6.7 | 0.034 | 58.6 |
| 3 | $(C_8H_{17}-OCH_2CH(OH)CH_2)_2-NCH_2COOH$ | 54 | $(C_{8-10}H_{17-21})-O(CH_2)_3-NH_2$ | 0.045 | 32.4 | 0.037 | 38.7 | 67.4 | 77.8 | 3.8 | 0.029 | 44.9 |
| 4 | $C_8H_{17}-CH=CH-C_7H_{15}-C(=O)-N(CH_3)-CH_2COOH$ | 54 | $(C_{8-10}H_{17-21})-O(CH_2)_3-NH_2$ | 0.043 | 32.4 | 0.034 | 40.7 | 66.0 | 80.2 | 5.7 | 0.024 | 42.3 |
| 5 | $C_{13}H_{27}-OCH_2CH(OH)CH_2N(CH_3)-CH_2COOH$ | 54 | $(C_{8-10}H_{17-21})-O(CH_2)_3-NH_2$ | 0.043 | 31.9 | 0.035 | 38.2 | 67.8 | 77.6 | 3.3 | 0.029 | 46.3 |
| 6 | $C_9H_{19}-C_6H_4-OCH_2CH_2O-CH_2CH(OH)CH_2-N(CH_3)-CH_2COOH$ | 54 | $(C_{8-10}H_{17-21})-O(CH_2)_3-NH_2$ | 0.045 | 29.7 | 0.039 | 39.6 | 67.2 | 79.3 | 4.2 | 0.033 | 47.8 |
| 7 | $(C_8H_{17})_2-NCH_2PO_3H_2$ | 10 | $(C_{8-10}H_{17-21})-O(CH_2)_3-NH_2$ | 0.044 | 29.9 | 0.034 | 37.6 | 67.4 | 75.6 | 3.6 | 0.034 | 52.9 |
| 8 | $(C_8H_{17}-OCH_2CH(OH)CH_2)_2-NCH_2CH_2OPO_3H_2$ | 20 | $(C_{8-10}H_{17-21})-O(CH_2)_3-NH_2$ | 0.045 | 29.7 | 0.038 | 40.9 | 66.3 | 80.8 | 5.4 | 0.032 | 48.4 |
| 9 | $(C_8H_{17}-OCH_2CH(OH)CH_2)_2-NCH_2CH_2OPO_3H_2$ | 54 | $(C_{8-10}H_{17-21})-O(CH_2)_3-NH_2$ | 0.045 | 29.7 | 0.038 | 39.4 | 66.8 | 78.5 | 4.8 | 0.025 | 36.6 |
| 10 | $(C_8H_{17})_2-NCH_2CH_2OPO_3H_2$ | 54 | $(C_{8-10}H_{17-21})-O(CH_2)_3-NH_2$ | 0.046 | 28.4 | 0.042 | 39.2 | 66.5 | 77.8 | 5.4 | 0.034 | 44.9 |
| 11 | $(2\text{-ethylhexyl-}OCH_2CH(OH)CH_2)_2-NCH_2CH_2OPO_3H_2$ | 54 | $(C_{8-10}H_{17-21})-O(CH_2)_3-NH_2$ | 0.044 | 28.3 | 0.038 | 38.9 | 66.3 | 76.8 | 5.0 | 0.028 | 39.7 |
| 12 | $C_{14}H_{29}OCH_2CH(OH)CH_2OCH_2C(=O)(OC_2H_5)C_2H_4OP(=O)(OH)_2$ | 54 | $(C_{8-10}H_{17-21})-O(CH_2)_3-NH_2$ | 0.044 | 30.8 | 0.036 | 38.9 | 66.7 | 77.3 | 5.1 | 0.030 | 48.2 |
| 13 | $CH_{13}H_{27}CH_2CH(OH)CH_2N(CH_3)-CH_2COOH$ | 54 | $(C_{8-10}H_{17-21})-O(CH_2)_3-NH_2$ | 0.045 | 31.4 | 0.035 | 40.3 | 65.4 | 78.5 | 4.2 | 0.030 | 52.1 |

By comparison with the Control, it is evident that Examples 1 to 13 carried out in accordance with the invention yield iron mineral concentrates with a low % P assay and a P distribution considerably lower than in the Control. This is achieved without undue losses of iron (see % Fe grade and recovery), and also with some improvement in the silicate flotation. Some of the tests show an iron recovery that is essentially superior to the results reported in Japanese Pat. applications Nos. 58-159,856 and 58-156,358.

Having regard to the foregoing disclosure, the following is claimed as the patentable and inventive embodiments thereof:

1. A process for the froth flotation beneficiation of iron minerals from iron ores containing silicate and phosphate minerals while preferentially and selectively floating the silicate and phosphate minerals, which comprises carrying out the flotation at an alkaline pH in the presence of a primary amine having the formula:

$$R_1\text{-}[OC_{n1}H_{2n1}]_{m1}\text{-}[NHC_{n2}H_{2n2}]_{m2}\text{-}NH_2 \qquad \text{I}$$

in which:

$R_1$ is a hydrocarbon group having from about six to about eighteen carbon atoms;

$n_1$ and $n_2$ are 2 or 3; and $m_1$ is from 0 to 1 and $m_2$ is from 0 to 1; and an anionic group containing compound having the formula:

$$R_2\text{-}[O]_{m6}\text{-}[C_{n3}H_{2n3}O]_{m3}\text{-}[CH_2\underset{\underset{OH}{|}}{C}HCH_2]_{m4}\text{-}[X]_{m5}\text{-}\overset{\overset{R_3}{|}}{N}\text{-}R_4 \qquad \text{II}$$

in which:

$R_2$ is a hydrocarbon group having from about one to about twenty-four carbon atoms;

X is a a group $$\text{-}\underset{\underset{O}{\|}}{C}\text{-} \text{ or } \text{-}OCH_2\underset{\underset{O}{\|}}{C}\text{-}$$

$n_3$ is a number form 2 to 4;

$m_3$ is a number from 0 to 4 ;

$m_4$ is 0 or 1;

$m_5$ is 0 or 1;

$m_6$ is 0 or 1;

$R_3$ is selected from the group consisting of hydrogen; hydrocarbon groups having from one to about eighteen carbon atoms; and $$R_2[O]_{m6}\text{-}[C_{n3}H_{2n3}O]_{m3}\text{-}[CH_2\text{-}\underset{\underset{OH}{|}}{C}H\text{-}CH_2]_{m4}\text{-}[X]_{m5};$$

$R_4$ is selected from the group consisting of methylene carboxylic acid $\text{-}CH_2COOH$; methylene phosphonic acid $$\text{-}CH_2\text{-}\overset{\overset{O}{\|}}{P}\text{-}(OH)_2;$$

and ethylene phosphoric acid $$\text{-}CH_2CH_2\text{-}O\text{-}\overset{\overset{O}{\|}}{P}\text{-}(OH)_2;$$

and salts thereof.

2. A process according to claim 1 in which $R_1$ is aliphatic hydrocarbon and $m_2$ is 0.

3. A process according to claim 1 in which the total number of carbon atoms in the $R_2$ and $R_3$ hydrocarbon groups are within the range from about twelve to about twenty-five, and $m_4$ is 1.

4. A process according to claim 1 in which the number of carbon atoms in $R_2$ and $R_3$ is within the range from about one to about eighteen.

5. A process according to claim 1 in which $n_1$ is 2.

6. A process according to claim 1 in which $n_1$ is 3.

7. A process according to claim 1 in which $m_1$ is 0.

8. A process according to claim 1 in which $m_1$ is 1.

9. A process according to claim 1 in which $m_2$ is 0.

10. A process according to claim 1 in which $m_2$ is 1.

11. A process according to claim 1 in which $n_3$ is 2.

12. A process according to claim 1 in which $n_3$ is 3.

13. A process according to claim 1 in which $n_3$ is 4.

14. A process according to claim 1 in which $m_3$ is 0.

15. A process according to claim 1 in which $m_3$ is 1.

16. A process according to claim 1 in which $m_4$ is 0.

17. A process according to claim 1 in which $m_4$ is 1.

18. A process according to claim 1 in which $m_5$ is 0.

19. A process according to claim 1 in which $m_5$ is 1.

20. A process according to claim 1 in which $R_3$ is hydrogen.

21. A process according to claim 1 in which $R_3$ is hydrocarbon.

22. A process according to claim 1 in which $R_3$ is $$R_2[O]_{m6}[C_{n3}H_{2n3}O]_{m3}[CH_2\text{-}\underset{\underset{OH}{|}}{C}H\text{-}CH_2]_{m4}[X]_{m5}$$

23. A process according to claim 1 in which $R_4$ is methylene carboxylic acid.

24. A process according to claim 1 in which $R_4$ is methylene phosphonic acid.

25. A process according to claim 1 in which $R_4$ *is ethylene phosphoric acid.*

26. A process according to claim 1 in which the amounts of primary amine and anionic group containing compound are within the range from about 5 to about 250 g per ton of ore.

* * * * *